US007163307B1

(12) United States Patent
Clark et al.

(10) Patent No.: US 7,163,307 B1
(45) Date of Patent: Jan. 16, 2007

(54) ILLUMINATED DOCUMENT CADDY

(76) Inventors: Brooke Baily Clark, 2410 Ellis St., #205, Dallas, TX (US) 75204; Gary R. Baily, 3300 N. A St., Bldg. 2-100, Midland, TX (US) 70705

( * ) Notice: Subject to any disclaimer, the term of this patent is extended or adjusted under 35 U.S.C. 154(b) by 140 days.

(21) Appl. No.: 11/000,716

(22) Filed: Dec. 1, 2004

Related U.S. Application Data

(60) Provisional application No. 60/526,692, filed on Dec. 3, 2003.

(51) Int. Cl.
*F21V 33/00* (2006.01)

(52) U.S. Cl. ..... 362/99; 362/156; 362/295; 40/661.02

(58) Field of Classification Search ..... 362/98, 362/99, 109, 156, 253, 295; 40/661.02, 661.07; 359/807; 281/31, DIG. 1; 206/232
See application file for complete search history.

(56) References Cited

U.S. PATENT DOCUMENTS

| | | | | |
|---|---|---|---|---|
| 1,202,498 | A | 10/1916 | Findley | |
| 2,377,538 | A | 6/1945 | Cohen | |
| 2,395,760 | A * | 2/1946 | Quan | 362/99 |
| 3,885,145 | A | 5/1975 | Wise | |
| 4,073,068 | A | 2/1978 | Albenda | |
| 4,209,824 | A | 6/1980 | Kaufman | |
| 4,286,399 | A | 9/1981 | Funahashi et al. | |
| 4,290,093 | A | 9/1981 | Thompson et al. | |
| 4,363,081 | A | 12/1982 | Wilbur | |
| 4,559,583 | A | 12/1985 | Ku | |
| 4,583,562 | A | 4/1986 | Stewart | |
| 4,969,068 | A | 11/1990 | Williams | |
| 5,066,158 | A | 11/1991 | Huang | |
| 5,355,115 | A | 10/1994 | Goor et al. | |
| 5,424,858 | A | 6/1995 | Gillotte | |
| 5,639,156 | A | 6/1997 | Broxson | |
| 5,709,409 | A * | 1/1998 | Engel | 281/29 |
| 5,813,748 | A | 9/1998 | Maxymych | |
| 6,076,079 | A | 6/2000 | Boston et al. | |
| 6,409,357 | B1 * | 6/2002 | Thompson et al. | 362/98 |
| 6,409,360 | B1 | 6/2002 | Contant et al. | |
| 6,435,695 | B1 | 8/2002 | Altman | |
| 6,637,907 | B1 | 10/2003 | Levy | |
| 6,796,673 | B1 * | 9/2004 | Dempsey et al. | 362/154 |
| 6,808,208 | B1 * | 10/2004 | Ward | 281/31 |
| 2004/0099546 | A1 * | 5/2004 | Schlosser | 206/232 |

* cited by examiner

*Primary Examiner*—Stephen F Husar
(74) *Attorney, Agent, or Firm*—Craig Metcalf; Snell & Wilmer L.L.P.

(57) ABSTRACT

A document caddy for facilitating the viewing and reading of a restaurant check in low light conditions that includes a generally rigid backing that includes a front cover and a back cover, the back cover pivotally connected to the front cover. The document caddy further including a pocket attached to the back cover for containing the restaurant check, a light source attached to the backing and disposed to illuminate the restaurant check held in the document caddy, a power source electrically connected to the light source, and a switch electrically connected to the light source and the power source. The light source may include a hood to limit the arc of light projecting from the light source and a lens to alter light emitted from the light source to facilitate the ambiance of an establishment. Additionally, the luminous intensity of the light source may be selectively adjustable.

7 Claims, 5 Drawing Sheets

ILLUMINATED DOCUMENT CADDY

CROSS-REFERENCED RELATED APPLICATIONS

This application claims the benefit of U.S. Provisional Application No. 60/526,692, filed Dec. 3, 2003 and entitled "ILLUMINATED DOCUMENT CADDY" invented by Brooke Baily and Gary R. Baily.

BACKGROUND OF THE INVENTION

The present invention relates to document caddies. More specifically, the present invention relates to document caddies, such as restaurant check presenters, for use in low light conditions.

For persons that frequent various restaurants, nightclubs, bars, and other dimly lit establishments, a source of continuing frustration is a lack of sufficient light for a person to inspect the bill, pay the bill, and determine a suitable tip. Though the dim lighting contributes to the ambiance of such establishments, the dim lighting also compounds an additional problem of checks with small or faded text that is difficult to read under the best of lighting conditions. Similar problems may also arise in dimly lit establishments when reading other documents, such as menus, wine lists, entertainment programs, and event descriptions. Often these documents are presented to guests in various types of document caddies, such as check presenters and menu covers.

Another source of frustration for performers, wait staff, and owners of restaurants, nightclubs, bars, and other dimly lit establishments is additional light sources such as table lamps or flash lights can be serious distractions to customers and performers, which may interfere with the quality of the performance, quality of the service, and enjoyment of the customers. Additionally, additional light sources tend to project too much light into their surroundings which can affect the ambiance of the establishment. Additional sources of light may also interfere with the wait staff ability to perform by temporarily preventing the wait staff from being able to see clearly as their eyes adapt from viewing the light source to seeing in the dimly lit environment of restaurants, nightclubs, bars, and other establishments.

Therefore, it would be an advancement in the art to provide a document caddy with sufficient illumination to easily read by, but not so much that the illumination interferes with ambiance of the establishment. Furthermore, it would be an advancement in the art to provide a document caddy with a magnifier for a user to more easily read small or faded type. It would also be an advancement to provide a document caddy with a light source whose luminous intensity is adjustable. Additionally, it would be an advancement in the art to provide a document caddy that is durable, lightweight, and inexpensive to manufacture.

BRIEF SUMMARY OF THE INVENTION

The apparatus of the present invention has been developed in response to the present state of the art, and in particular, in response to the problems and needs in the art that have not yet been fully solved by currently available document caddies, restaurant check presenters, and menu covers. Thus, the present invention provides a document caddy and more specifically a restaurant check presenter for facilitating the viewing and reading of a restaurant check in low light conditions without disturbing the ambiance provided by the low light conditions.

In accordance with the invention as embodied and broadly described herein in the preferred embodiment, document caddies are provided, including a restaurant check presenter. According to one configuration, the restaurant check presenter may include a substantially rigid backing, a pocket attached to the backing for containing the restaurant check, a light source attached to the backing and disposed to illuminate the restaurant check held in the restaurant check presenter, a power source electrically connected to the light source, and a switch electrically connected to the light source and the power source.

The backing includes a front cover and a back cover pivotally connected to the front cover. The front cover may protect the privacy of a bill to be presented to a customer, as well as protect the privacy of the amount of payment in satisfaction of the bill. A backing made of rigid material may provide the aesthetic qualities of improved weight and a feel of quality. A backing made of rigid material may also facilitate the opening and closing of the restaurant check presenter. A backing made of rigid material may also provide a surface suitable for the customer to write upon.

The light source may be attached to the front cover in order to position the light source to illuminate a restaurant check or payment held in the restaurant check presenter. The light source may include a diffusion lens or a hood that includes an aperture to permit light from the light source to project toward the backing in an arc ranging from about 5° to about 110° to illuminate the documents held in the document caddy. The light source may be an incandescent bulb, LED, or other source of light known in the art.

The power source electrically connected to the light source may include a battery or a capacitor. The light source and the power source may be electrically connected to a switch by conductive material. The material may be wires or the traces on a printed circuit board ("PCB"). The switch may be a pressure switch or other switch known in the art for turning the light source on and off in order to conserve the energy stored in the power source. The power source and switch may be disposed close to the light source on the front cover for ease of maintenance and repair.

The pocket attached to the back cover may hold a restaurant receipt or bill for the customer. The pocket may be of any shape and secured to the backing on two or three sides. The pocket may be attached to the backing on one side or on all four sides. Often, the bill, check or receipt may include small print or type that may be difficult to read. To facilitate the reading of the bill, check or receipt, the pocket may include a magnifier. A customer may place the bill, check, or receipt under the magnifier portion of the pocket to more easily read the text.

The restaurant check presenter may also include a clasp for attaching the front cover to the back cover. The clasp can be used to secure bill, check, receipt, and money within the restaurant check presenter. The clasp may be a snap clasp, a press fit clasp, or any other clasping means known in the art. The clasp may also include a magnet attached to the front cover and a second magnet attached to the back cover. The magnets allow the restaurant check presenter to be closed and held closed by the magnetic force of the magnets. A user need only apply force to overcome the magnetic force of the magnets to open the restaurant check presenter.

An alternative configuration of a document caddy for facilitating the viewing and reading of various documents in low light conditions may include a generally rigid backing, a light source connected to the backing and disposed to illuminate a document held in the document caddy, a power source electrically connected to the light source, and a switch attached to the backing and electrically connected to the light source and the power source that allows for the selective adjustment of the luminous intensity of the light source. This configuration may also include all of the elements discussed above with the restaurant check presenter.

This configuration may also include a pocket that includes a magnifier, a back cover that includes the rigid backing pivotally connected to a front cover, and a pressure switch. This configuration may also include a clasp for attaching the front cover to the back cover. The clasp may similarly include a magnet attached to the front cover and a second magnet attached to the back cover for retaining the document caddy in a closed position. Additionally, the light source may include a lens and be disposed generally at the middle of the front cover or in an upper corner of the front cover to illuminate documents held in the document caddy.

Alternatively, the document caddy for facilitating the viewing and reading of various documents in low light conditions may include a light source connected to the backing. Light projecting from the backing is restricted to only project toward the backing in an arc ranging from about 5° to about 90° to illuminate the documents held in the document caddy. The light may also project in an arc ranging from about 5° to about 60° or ranging from about 10° to about 45°. Alternatively, the light may also project in an arc in the range of about 15° to about 40° or in the range of about 15° to about 30°. The document caddy may include a hood that prevents light from projecting from the light source except for an aperture that defines the arc of projected light. The hood may include a reflective inner surface and a lens may cover the light source or be disposed so that light passes through the lens before reaching the backing.

Through the use of the document caddies of the present invention, documents including checks, bills, receipts, and various forms of currency may be handled in a discrete manner under low light conditions. Furthermore, the text of checks, bills, receipts, menus, and other documents may be read under low light conditions without distracting other patrons, wait staff, or performers of the establishment. These and other features and advantages of the present invention will become more fully apparent from the following description and appended claims, or may be learned by the practice of the invention as set forth hereinafter.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments, which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The presently preferred embodiments of the invention will be best understood by reference to the drawings, wherein parts are designated by numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in FIGS. 1 through 6, is not intended to limit the scope of the invention, but is merely representative of presently preferred embodiments of the invention.

For this application, the phrase "connected to" refers to any form of interaction between two or more entities, including mechanical, electrical, magnetic, electromagnetic, and thermal interaction. The phrase "attached to" refers to a form of mechanical coupling that restricts relative translation or rotation between the attached objects. The phrase "pivotally attached to" refers to forms of mechanical coupling that permit relative rotation, respectively, while restricting other relative motion.

Figure 1:
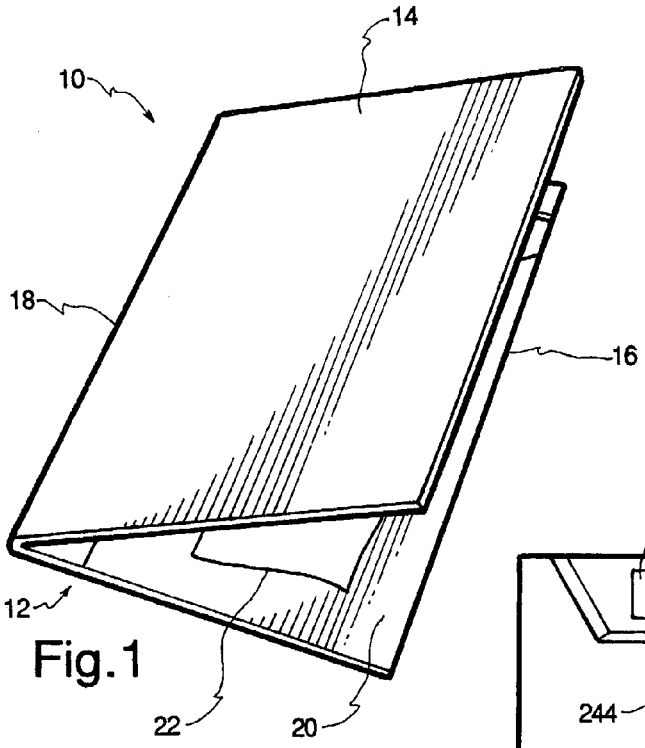
FIG. 1 is a perspective view illustrating a document caddy.

Referring to FIG. 1, a perspective view illustrates a document caddy, specifically a restaurant check presenter 10. The restaurant check presenter 10 includes a generally rigid backing 12. The generally rigid backing 12 provides a customer with a firm and stiff surface to write on in order to calculate a tip or sign a credit card receipt. The backing 12 includes a front cover 14 that is pivotally connected to a back cover 16 by a spine 18. The front cover 14 of the restaurant check presenter 10 is folded over along its spine 18 and is shown in an almost closed position with the back cover 16. The back cover 16 is also shown with a pocket 20 attached. The pocket 20 is shown holding a document 22 such as restaurant check, a coupon, a receipt, or money in the restaurant check presenter 10.

Figure 2:
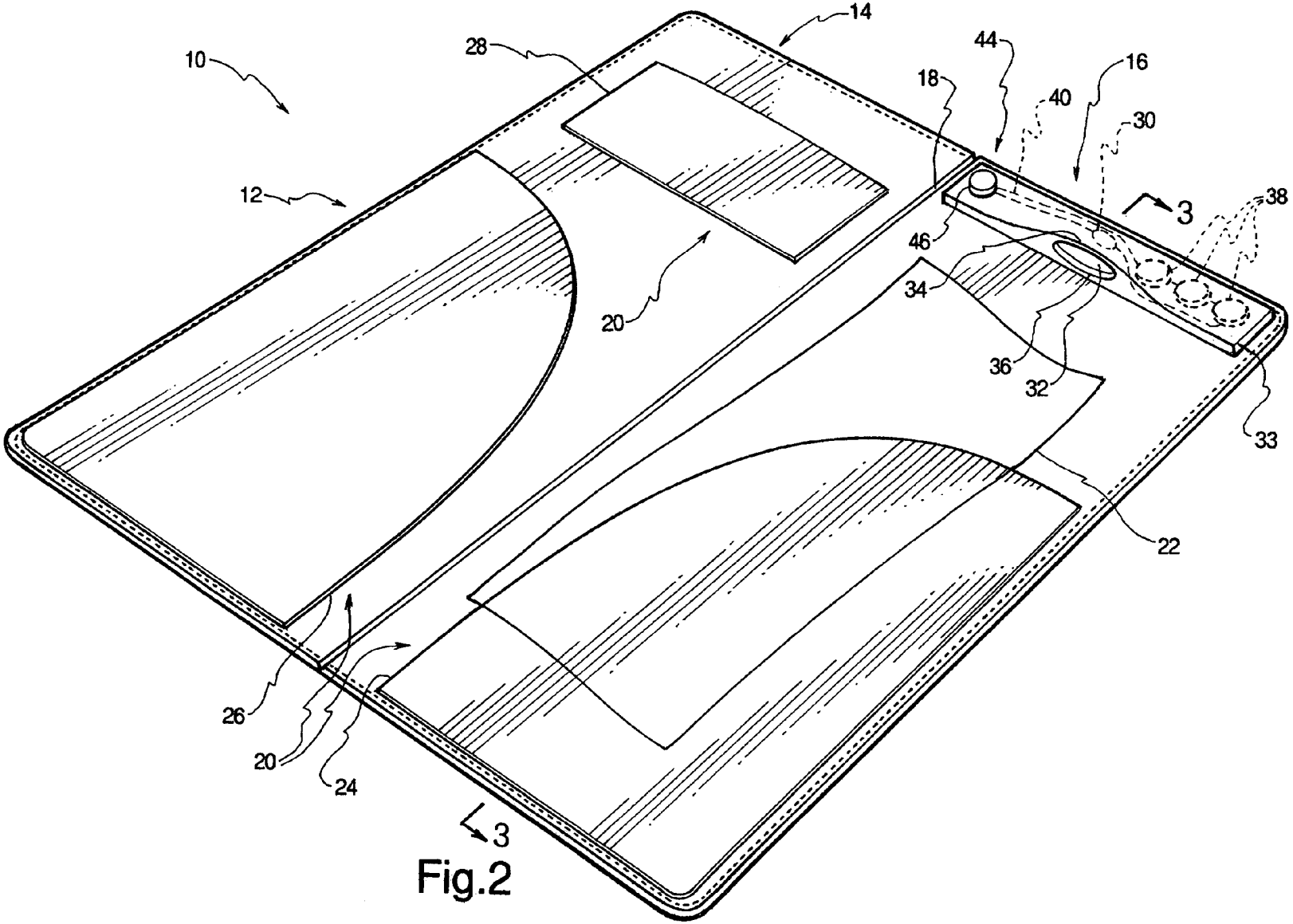
FIG. 2 is a perspective view illustrating the document caddy of FIG. 1 in an open configuration.

Referring to FIG. 2, a perspective view further illustrates the document caddy configured as the restaurant check presenter 10 of FIG. 1. The front cover 14 and a back cover 16 are pivotally attached to each other at the spine 18. The spine 18 may be a pliant fold or hinge. The restaurant check presenter 10 is thereby capable of folding at the spine 18 allowing the front and back covers 14, 16 to overlap. The overlapping covers 14, 16 help to conceal the details of a document 22 such as a restaurant check, bill payment, or tip amount, thus allowing settlement of a bill to occur discreetly.

As shown, the document 22 is a restaurant check that is retained in a right pocket 24. The restaurant check presenter 10 also includes other pockets 20, specifically a left pocket 26 and a credit card holder 28. The right pocket 24 and the left pocket 26 are attached on two sides to the backing 12. The credit card holder is attached on three sides to the backing 12 and is disposed on the front cover 14. The pockets 20 may be made of plastic, leather, cloth, cardboard, metal, some combination thereof or other suitable material. Furthermore, the pockets 20 could be clear or opaque.

As noted above, the front cover 14 and a back cover 16 of the restaurant check presenter 10 comprise a backing 12 to provide a rigid or semi-rigid surface on which to write. The backing 12 may be made of vinyl surrounding a cardboard core. Alternatively, the backing 12 could be made from leather, cloth, plastic, rigid foam, wood, metal, composite, or some combination thereof. The backing 12 may be clear or opaque.

The restaurant check presenter 10 illustrated in FIG. 1 also includes a light source 30 shown by hidden lines attached to the back cover 16. The light source 30 may be a light emitting diode (hereinafter "LED"), an incandescent bulb, or any other light-emitting source known in the art. As shown, the light source 30 is a single LED or a single bulb. Alternatively, a plurality of LEDs or other light-emitting sources may be used.

The light emitted from the light source 30 passes through a lens 32. The lens may disperse, focus, or filter the light emitted by the light source 30 onto the back cover 16. Alternatively, the lens may polarize the light emitted by the light source 30.

The light source 30 may be attached to a housing 33 that is attached to the backing 12. The housing 33 may include a printed circuit board ("PCB" not shown) with the light source 30 attached to the PCB (not shown). The light source 30 is positioned at the top of the back cover 16 and is shaped to provide a relatively short and flat profile.

The housing 33 includes a hood 34 that covers the light source 30. The hood 34 directs the light emitted from the light source 30 out of an aperture 36. The hood 34 and the aperture 36 permits light from the light source 30 to only project toward the backing 12 in an arc ranging from about 5° to about 90° to illuminate documents that may be held in the restaurant check presenter 10.

The restaurant check presenter 10 also includes a power source 38 shown by hidden lines connected to the light source 30 by conductive material 40. The power source 38 may be a small battery, such as a 3 volt battery or the like. As shown, the power source 38 includes three serially connected batteries. The batteries may also be connected in parallel. The power source 38 provides electrical energy to operate the light source 30. The conductive material 40 may be wires, the traces on a PCB, or any other device known in the art that may be used to provide an electrical connection. The power source 38 may be enclosed in the housing 33 to protect the power source 38 from water or other contaminants and to allow the power source 38 to be replaced as needed without damaging the restaurant check presenter 10.

The light source 30 and power source 38 are electrically connected by the conductive material 40 to a switch 44 to form a circuit. The switch 44 is able to control the illumination of the light source 30 by completing or breaking the circuit to cause the light source 30 to illuminate or not illuminate, respectively. The switch 44 also saves power by breaking the circuit when not in use, thereby extending the life of the power source 38.

In the illustrated embodiment the switch 44 is a pressure switch attached to the housing 33. Alternatively, the switch 44 could be an on/off toggle switch or a variable resistor. The switch 44 may have a protrusion 46 that projects beyond the plane created by the front cover 14. The protrusion 46 could be biased by a spring (not shown) to push the protrusion 46 toward a projecting position. When the protrusion 46 of the pressure switch 44 is in a projecting position, the circuit is completed and the light source 30 is on and illuminated. When the protrusion 46 is pushed into its housing against the force of the spring (not shown), the circuit is broken and the light source 30 is turned off.

According to this arrangement, the light source 30 illuminates when the restaurant check presenter 10 is open because the back cover 16 is not pushing the protrusion 46 of the switch 44 into its housing. A patron can thereby decipher the bill under dimly lit circumstances. When the restaurant check presenter 10 is closed, the light source 30 is off because the front cover 14 is pushed against the protrusion 46 of the switch 44, thus breaking the circuit. The energy of the power source 38 is thereby conserved when the restaurant check presenter 10 is not in use.

Figure 3:
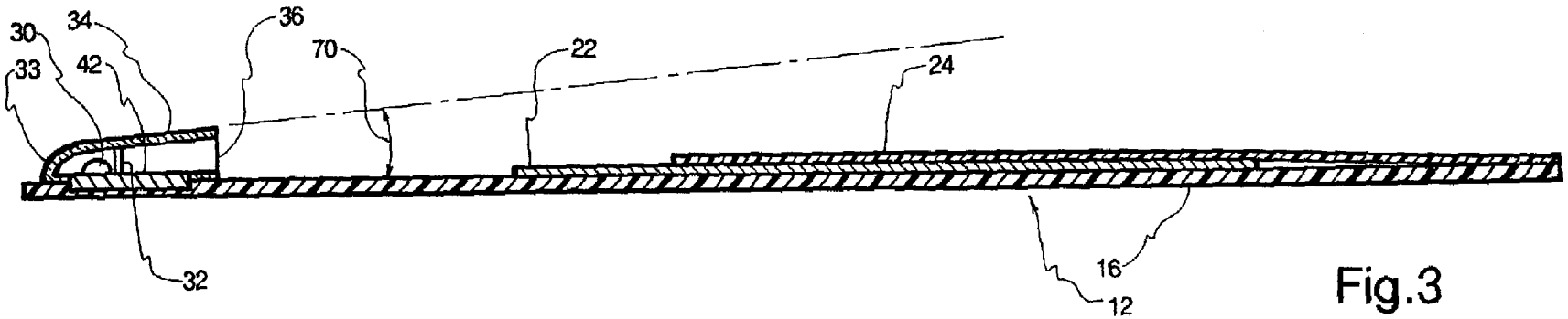
FIG. 3 is a side elevation cross-sectional view along the line 3—3 of the document caddy of FIG. 2.

Referring to FIG. 3, a cross sectional side elevation view taken along line 3—3 of FIG. 2 illustrates the illumination of the restaurant check 22 by the light source 30. As shown, the light source 30 is mounted on a PCB 42. The PCB 42 is embedded in the backing 12 to help provide a lower profile of the housing 33.

The restaurant check 22 is held by the right pocket 24 against the backing 12. The restaurant check 22 is illuminated by the light source 30 passing light through the lens 32. The light is directed by the hood 34 out of the housing 33 through the aperture 36.

The hood 34 restricts the emitted light to an arc 70 measured from the plane of the backing 12 to the height of the arc 70. The arc 70 may range from about 5° to about 90°, which is perpendicular to the plane of the backing 12. Alternatively, the light may be projected in an arc greater than 90°. The arc 70 may also range from about 10° to about 60° or range from about 15° to about 30°. The hood 34 helps to prevent excess light from being projected, which may be a distraction to the performers and wait staff of an establishment. Additionally, the excess light may detract from the ambiance of an establishment.

Figure 4:
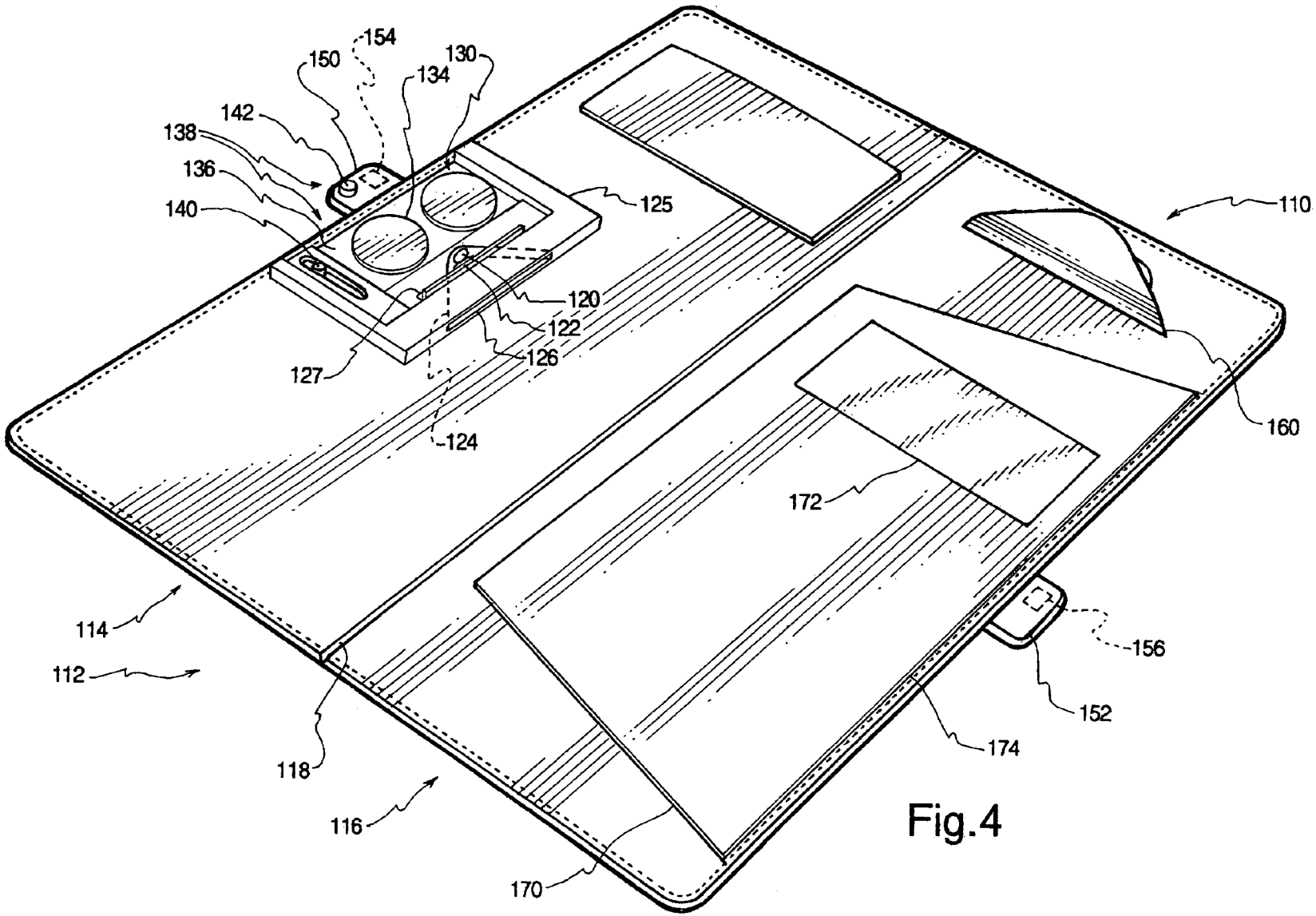
FIG. 4 is a perspective view of an alternative configuration of a document caddy.

Referring to FIG. 4, a perspective view illustrates an alternative embodiment of a document caddy 110. Like the restaurant check presenter 10 of FIG. 1, the document caddy 110 includes a backing 112 forming a front cover 114 and a back cover 116. The front cover 114 and the back cover 116 are pivotally attached to each other at a spine 118, in a similar manner as described in conjunction with the restaurant check presenter 10 of FIG. 1.

The document caddy 110 also includes a light source 120 and a lens 122 attached at about the middle of the front cover 114. The light source 120 and the lens 122 may be covered by a hood 124 of a housing 125 having an aperture 126. A cover of the housing 125 is not shown for demonstrative purposes. The hood 124 extends from the light source 120 to the aperture 126. The hood 124 may be completed by installing the cover (not shown) of the housing 125.

The hood 124 restricts light emitted from the light source 120 to only projecting through the aperture 126. As light is emitted from the light source 120, the light passes through the lens 122. The lens 122 may evenly distributes the light across an arc of light projecting through the aperture 126 to illuminate a document on the back cover 116. Alternatively, the lens 122 may be a polarizing lens, a filter that only allows certain bandwidths of light to pass, or a colored lens.

In this configuration, the lens 122 rests in a groove 127 of the housing 125. The lens 122 may be changed by removing the housing cover (not shown) and the lens 122 from a groove 127. Then a desired lens is paced in the groove 127 and the housing cover (not shown) replaced. The light source 120 may also be accessed by removing the housing cover (not shown).

The document caddy 110 of FIG. 4 also includes a power source 130 normally enclosed in the housing 125 for providing electrical energy needed to operate the light source 120. The power source 130, as shown, includes two batteries 134. Alternatively, the power source 130 may be a single battery. Additionally, the battery may be any type or size of reasonably small battery, such as an AAA or AAAA-sized battery, a watch battery, or a calculator battery, etc.

The light source 120, power source 130, and switch 138 are shown mounted on a PCB 136 and electrically connected by the traces on the PCB 136 to form a circuit. Specifically, the power source 130 and the light source 120 may be removably mounted on the PCB 136 to facilitate maintenance and repair, while the switch 138 may be soldered to the PCB 136.

The switch 138 controls the illumination of the light source 120 and includes a variable resistor 140 and a pressure switch 142. The variable resistor 140 allows the luminous intensity of the light source 120 to be selectively adjusted to support rather than detract from the environment that the document caddy 110 is used in. In other words, the variable resistor 140 adjusts the power flowing to the light source 120 to produce more or less light. The variable resistor 140 can be set by the owner of manager of an establishment to project light that does not disturb the ambiance of the dimly lit establishment, while providing enough light to facilitate a customer's review of a restaurant check, receipt, or other document. The light source 120, the lens 122, the batteries 134, and the variable resistor 140, may be hidden from view by a cover (not shown).

The pressure switch 142 functions similarly to the pressure switch 44 of FIG. 2. The pressure switch 142 is also part of a first clasp component 150 that engages a second clasp component 152. The first clasp component 150 is attached to the front cover 114 and the second clasp component 152 is attached to the back cover 116. When the first clasp component 150 engages the second clasp component 152, the pressure switch 142 is depressed, breaking the circuit between the power source 130 and the light source 120. The disengaging of the first clasp component 150 with the second clasp component 152 by opening the document caddy 110, releases the switch 142, which completes the circuit and illuminates the light source 120.

The first clasp component 150 and the second clasp component 152 each include a magnet 154 and 156 respectively. The first clasp component 150 and the second clasp component 152 attach the front cover 114 to the back cover 116 by the magnetic force of the two magnets 154 and 156. Alternative clasps may be used that are rotated, undone, unsnapped, unhooked, or otherwise disengaged from a corresponding component on the opposite cover.

The document caddy 110 also includes a retaining clip 160 for retaining documents such as bills, checks, paper currency, other documents, or credit cards. The retaining clip 160 is attached to the backing 112. The retaining clip 160 is biased against the backing 112 by a spring (not shown) to secure documents to the backing 112. Alternatively, the retaining clip 160 could be an elastic band or similar device for maintaining a document against the backing 112.

The document caddy 110 includes a pocket 170 that includes a magnifier 172 that magnifies the print of the text placed behind it to facilitate reading of bills, checks, menus, and other small written or printed material. The magnifier 172 may be made of plastic or glass, or another suitable material for enlarging the image of a document placed behind it. The magnifier 172 may be integrally formed with the pocket 170. As shown, the pocket 170 is attached to the back cover 116 on only one side 174.

Figure 5:
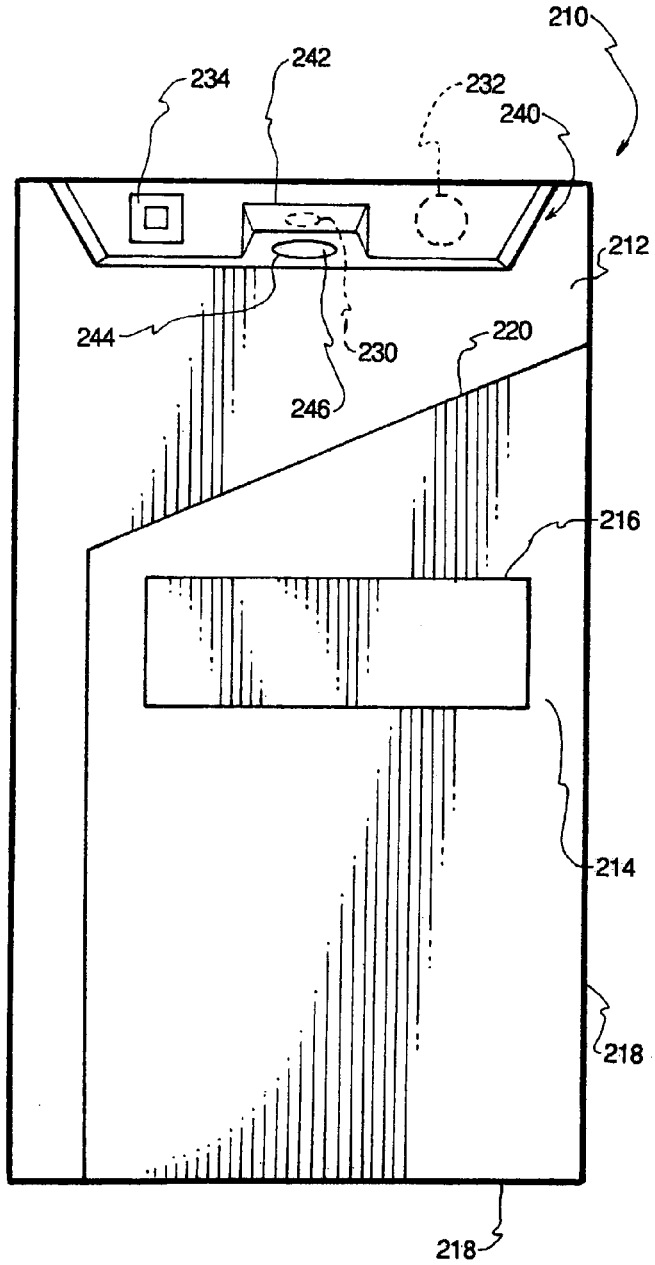
FIG. 5 is a front elevation view illustrating an alternative document caddy that may be used as a check presenter.

Referring to FIG. 5, a front elevation view illustrates an alternative document caddy 210. The document caddy 210 has a rigid backing 212. The document caddy 210, as shown, is a restaurant check presenter that includes a pocket 214 for holding documents to the document caddy 210. The pocket 214 includes a magnifier 216. The magnifier 216 may be made of clear polycarbonate or acrylic plastic that is attached to a flexible polypropylene sheet of the pocket 214. Of course other materials may be substituted, or the magnifier 216 and the pocket 214 may be integrally formed of one material. The pocket is attached to the rigid backing 212 on two edges 218. The edge 220 is unattached to allow documents, such as bills, restaurant checks, receipts, coupons, and cash to be held by the document caddy 210.

The document caddy 210 also includes a light source 230 for illuminating documents positioned on the backing 212 or held in the pocket 214. The light source 230 is powered by a power source 232 and controlled by a switch 234. The light source 230, power source 232, and the switch 234 are attached to the backing 212 by a housing 240 and are connected by the traces (not shown) of a PCB (not shown) that is disposed within the housing 240. The housing is disposed near the top of the document caddy 210. The housing 240 may be embedded within the backing 212 to limit the height of the document caddy 210.

The housing 240 includes a hood 242 that includes an aperture 244 that only permits light to project within an arc out of the housing 240 onto the backing 212 in order to view documents thereon. The housing 240 may include a lens 246 for altering the light emitted from the light source 230. The lens 246 may disperse the light so that a more evenly distributed arc of light is projected onto the backing 212. Alternatively, a lens 246 may be used to filter light from the light source 230 so that only certain colors of light are emitted. A lens 246 may also be colored to favor the projection of certain colors of light.

Using specific colors and or favoring certain colors of light may allow a customer to view a menu or settle a bill in a performance where normal light may be a distraction to other members of the audience or to the performers. For example, red light can be used to illuminate the type on a bill so that a customer can read the bill, without not significantly degrading that customer's and nearby customer's ability to watch a performance in the dark. Red light may also be less distracting to performers and the wait staff. Alternatively, blue light or even black light may be used.

Additionally, the color of light may also be used to reinforce the ambiance of an establishment or a holiday such as Saint Patrick's Day by using a green light to add holiday cheer. A multicolor lens may also be used to project different colors in celebration of Christmas or the Fourth of July. Alternatively, the light source 230 may include special bulbs or LEDs that favor the production of certain wavelengths of light, which may negate the need for lens 246.

Figure 6:
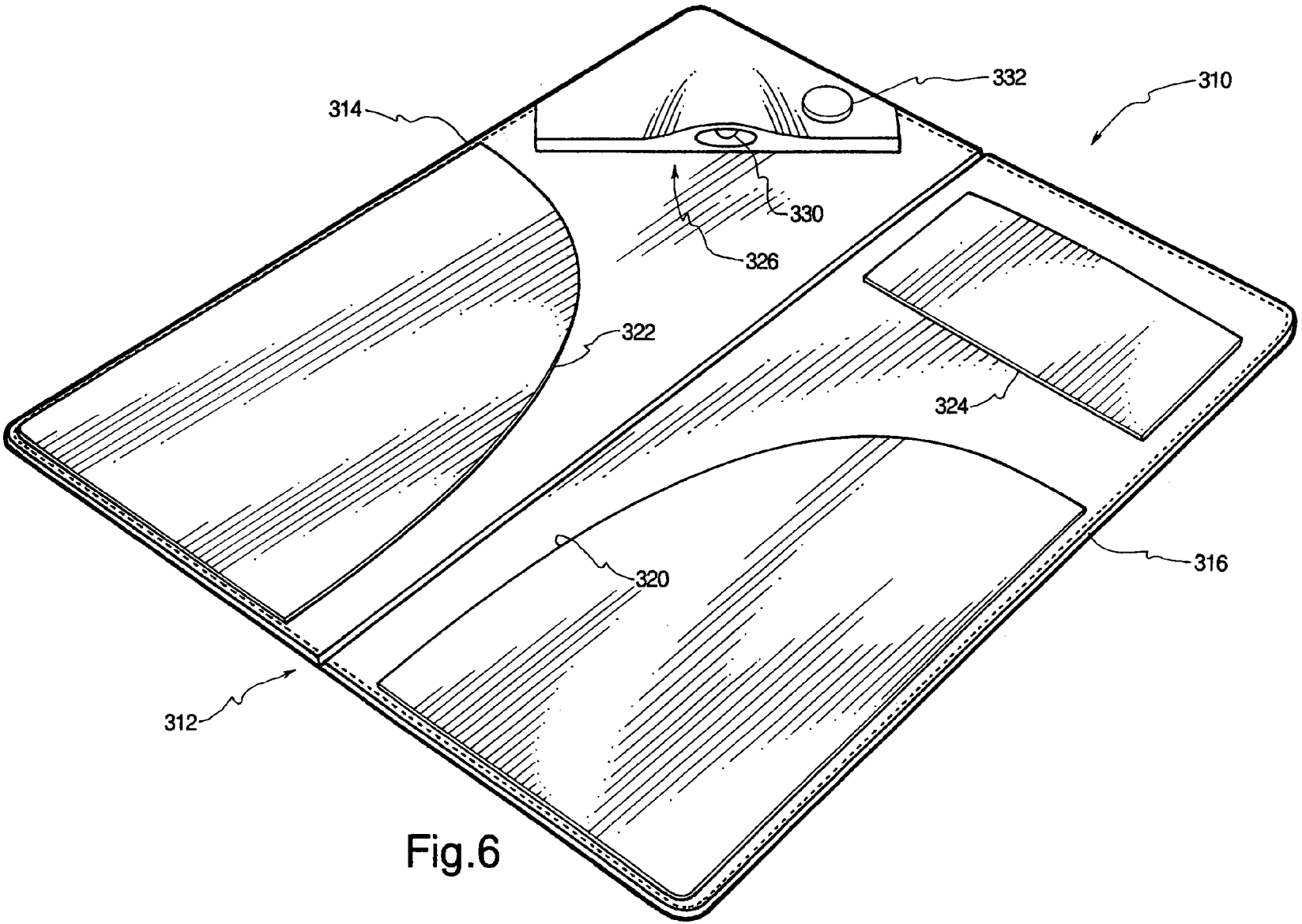
FIG. 6 is a perspective view of an alternative configuration of a document caddy.

Referring to FIG. 6, a perspective view illustrates an alternative configuration of a document caddy configured as a restaurant check presenter 310. As shown, the restaurant check presenter 310 includes backing 312. The backing 312 includes a front cover 314 pivotally attached to a back cover 316. The restaurant check presenter 310 also includes a right pocket 320, a left pocket 322, a credit card holder 324 and a housing 326 that contains a light source 330, a power source (not shown), and a push button 332.

The light source 330 is positioned in the upper corner of the front cover 314 to illuminate documents and cards that may be retained by the right pocket 320, the left pocket 322, or the credit card holder 324. Disposing the light source 330 in the upper corner of the front cover 314 facilitates both a left-handed person's and a right-handed person's use of the restaurant check presenter 310. For example, a left-handed person may find it easier to write on the front cover 314, while a right-handed person may find it easier to write on the back cover 316. In this configuration, both the front cover 314 and the back cover 316 are illuminated by the light source 330. Alternatively, the light source 330 may be positioned in the opposite upper corner of the back cover 316 to similarly illuminate the front cover 314 and the back cover 316.

The backing 312 of the restaurant check presenter 310 may be manufactured from metal, plastic, wood, ceramic, leather, cloth, composite, or any combination of these materials. For example, the backing 312 may include a rigid core of cardboard or plastic covered by an aesthetic cover made from vinyl, leather, fabric, or other plastic material. The core could be stamped, cast, cured, or injection molded. The aesthetic cover may be connected to the core by sewing, adhesives, mechanical fasteners, or injection molded around the core. Alternatively, the backing 312 may be formed as a unitary body. The pockets 320, 322, and 324 may be made of the same material as the cover and may also be connected to the cover by sewing, adhesives, mechanical fasteners, or fusing the pockets 320, 322, and 324 with the backing 312.

The housing 326 may be made of metal, plastic, wood, ceramic, leather, cloth, or any combination of these materials through various manufacturing processes such as stamping, molding, casting, sewing, and other processes known in the art. The housing 326 may be attached to the backing 312 by sewing, adhesives, mechanical fasteners, or may be integrally formed with the backing 312.

The present invention may be embodied in other specific forms without departing from its structures, methods, or other essential characteristics as broadly described herein. The described embodiments are to be considered in all respects only as illustrative, and not restrictive. All changes and alternatives apparent to one with skill in the art are to be embraced within the scope of the invention.

The invention claimed is:

1. A document caddy for facilitating the viewing and reading of various documents in low light conditions, the document caddy comprising:

a generally rigid backing;

a light source disposed to illuminate a document held in the document caddy, wherein the light source is connected to the backing;

a power source electrically connected to the light source; and a switch electrically connected to the light source and the power source, the switch connected to the rigid backing, wherein the luminous intensity of the light source is selectively adjustable.

2. The document caddy of claim 1, further comprising a pocket for retaining documents in the document caddy.

3. The document caddy of claim 2, wherein the pocket comprises a magnifier to facilitate the reading of text.

4. The document caddy of claim 1, wherein the backing comprises a front cover and a back cover, the back cover pivotally connected to the front cover.

5. The document caddy of claim 4, further comprising a clasp for attaching the front cover to the back cover.

6. The document caddy of claim 5, wherein the clasp comprises a magnet attached to the front cover and a second magnet attached to the back cover.

7. The document caddy of claim 1, further comprising a lens attached to the backing cover and disposed so that light from the light source passes through the lens.

* * * * *